US008354366B2

(12) United States Patent
Denome et al.

(10) Patent No.: US 8,354,366 B2
(45) Date of Patent: Jan. 15, 2013

(54) CLEANING PRODUCTS

(75) Inventors: Frank William Denome, Cincinnati, OH (US); Jose David Baez Chavez, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/361,266

(22) Filed: Jan. 30, 2012

(65) Prior Publication Data

US 2012/0240961 A1 Sep. 27, 2012

Related U.S. Application Data

(63) Continuation of application No. 12/612,059, filed on Nov. 4, 2009, now abandoned.

(60) Provisional application No. 61/116,415, filed on Nov. 20, 2008.

(51) Int. Cl.

| | |
|---|---|
| ***C11D 17/04*** | (2006.01) |
| ***C11D 1/722*** | (2006.01) |
| ***C11D 3/37*** | (2006.01) |
| ***C11D 3/386*** | (2006.01) |
| ***C11D 3/395*** | (2006.01) |
| ***B08B 9/20*** | (2006.01) |

(52) U.S. Cl. ..... 510/439; 510/296; 510/220; 510/226; 510/229; 510/230; 510/376; 510/392; 510/421; 510/475; 134/25.2

(58) Field of Classification Search ..... 510/439, 510/296, 220, 475, 226, 229, 230, 376, 392, 510/421; 134/25.2

See application file for complete search history.

(56) References Cited

U.S. PATENT DOCUMENTS

| | | | | |
|---|---|---|---|---|
| 4,106,991 | A | 8/1978 | Makussen et al. | |
| 4,242,219 | A | 12/1980 | Bogerman et al. | |
| 4,246,612 | A | 1/1981 | Berry et al. | |
| 4,689,297 | A | 8/1987 | Good et al. | |
| 4,760,025 | A | 7/1988 | Estell et al. | |
| 4,765,916 | A | 8/1988 | Ogar et al. | |
| 4,810,410 | A | 3/1989 | Diakun et al. | |
| 4,903,396 | A | 2/1990 | Grimes et al. | |
| 4,972,017 | A | 11/1990 | Smith et al. | |
| 5,114,611 | A | 5/1992 | Van Kralingen et al. | |
| 5,227,084 | A | 7/1993 | Martens et al. | |
| 5,288,627 | A | 2/1994 | Nielson et al. | |
| 5,324,649 | A | 6/1994 | Arnold et al. | |
| 5,453,216 | A | 9/1995 | Kellet | |
| 5,679,630 | A | 10/1997 | Baeck et al. | |
| 5,856,164 | A | 1/1999 | Outtrup et al. | |
| 5,888,954 | A | 3/1999 | Haerer et al. | |
| 6,221,829 | B1 | 4/2001 | Symes et al. | |
| 6,242,405 | B1 | 6/2001 | Lykke et al. | |
| 6,297,037 | B1 | 10/2001 | Barnett et al. | |
| 6,312,936 | B1 | 11/2001 | Poulose et al. | |
| 6,359,031 | B1 | 3/2002 | Lykke et al. | |
| 6,440,716 | B1 | 8/2002 | Svendsen et al. | |
| 6,638,748 | B2 | 10/2003 | Hatada et al. | |
| 6,867,031 | B2 | 3/2005 | Bisgard et al. | |
| 7,018,821 | B2 | 3/2006 | Becker et al. | |
| 7,153,818 | B2 | 12/2006 | Breves et al. | |
| 7,985,569 | B2 | 7/2011 | Aehle et al. | |
| 8,066,818 | B2 * | 11/2011 | Brooker et al. | 134/25.2 |
| 2002/0198125 | A1 | 12/2002 | Jones | |
| 2004/0259749 | A1 | 12/2004 | Braeckman et al. | |
| 2006/0094634 | A1 * | 5/2006 | Jekel et al. | 510/446 |
| 2007/0054828 | A1 | 3/2007 | Gentschev et al. | |
| 2008/0004201 | A1 | 1/2008 | Boutique et al. | |
| 2008/0248989 | A1 * | 10/2008 | Holderbaum et al. | 510/445 |
| 2009/0233830 | A1 * | 9/2009 | Dirr et al. | 510/224 |
| 2009/0263882 | A1 | 10/2009 | Shaw et al. | |
| 2011/0136205 | A1 | 6/2011 | Andersen et al. | |

FOREIGN PATENT DOCUMENTS

| | | | |
|---|---|---|---|
| EP | 1022334 | | 12/1999 |
| WO | WO 94/02597 | A1 | 2/1994 |
| WO | WO 97/43424 | A1 | 11/1997 |
| WO | WO 99/06521 | A1 | 2/1999 |
| WO | WO 99/23211 | A1 | 5/1999 |
| WO | WO 00/60060 | A2 | 10/2000 |
| WO | WO 02/08380 | A1 | 1/2002 |
| WO | WO 02/42408 | A2 | 5/2002 |

* cited by examiner

*Primary Examiner* — Lorna M Douyon

(74) *Attorney, Agent, or Firm* — Tiffany M. Zerby; Steven W. Miller

(57) ABSTRACT

A cleaning product in the form of a single or multi-compartment water-soluble pack comprising a cleaning composition and enveloping material, wherein at least one compartment contains an aqueous cleaning composition or an aqueous auxiliary composition enveloped by a warm water soluble material and wherein the aqueous cleaning or auxiliary composition comprises more than 15% by weight of the aqueous composition of free water.

19 Claims, No Drawings

CLEANING PRODUCTS

CROSS REFERENCE TO RELATED APPLICATIONS

This application is a continuation application of U.S. application Ser. No. 12/612,059 filed Nov. 4, 2009, now abandoned which claims the benefit of U.S. Provisional Application No. 61/116,415 filed Nov. 20, 2008.

TECHNICAL HELD

The present invention is in the field of cleaning products. In particular, it relates to a cleaning product in the form of a water-soluble pack having one or more compartments enveloped by a warm-water soluble material. The product provides excellent formulation flexibility, stability, improved handling and easiness of manufacture.

BACKGROUND

Products in unit dose form are found to be very attractive and convenient to some consumers because they avoid the need of the consumer to measure the product thereby giving rise to a more precise dosing and avoiding wasteful overdosing or underdosing. Lately, products in unit dose form have become one of the preferred forms for the user due to the easiness of use, in particular water-soluble pouches which present the added advantage of no need to unwrap.

Water-soluble packs consist of water-soluble enveloping material which encloses a cleaning composition. It is a common believe that compositions contained in the pack need to be free of water or have a very low level of free water otherwise the enveloping material would dissolve or the free water would negatively impact on the stability of the pack. Traditionally, water soluble packs contain compositions in solid form or in the form of anhydrous liquid (i.e. compositions with very low levels of free water).

Some cleaning ingredients are provided in the form of aqueous solutions. These ingredients can be difficult or costly to include in a solid cleaning composition or to include in an anhydrous liquid composition which would require to dry the water (involving a high use of energy) and to dissolve the active ingredient in an organic solvent. Examples of these cleaning ingredients include polymers, builders, surfactants, etc.

Current methods of incorporating liquid ingredients into solid detergent compositions include absorbing the liquid ingredient onto a solid carrier, for example by mixing, agglomeration or spray-on techniques. Typically, solid detergent compositions comprise only low amounts of these liquid detergent ingredients due to the difficulty and expense of incorporating these liquid ingredients into as solid detergent. Furthermore, the incorporation of liquid ingredients into solid detergent compositions can impact on the dissolution characteristics of the composition (for example as the result of forming surfactant gel phases), can increase the moisture pick-up by water sensitive ingredients and can also lead to problems of flowability. It would be advantageous to have a cleaning composition which allows the different ingredients to be in their natural state i.e., aqueous liquid or solid. This would facilitate the manufacturing process, increase the components stability and furthermore allow the delivery of liquid ingredients prior or post to the delivery of solid ingredients. For example differential dissolution of active ingredients would be beneficial in the case of enzyme/bleach compositions to avoid oxidation of enzymes by the bleach in the dishwashing liquor. It would also be advantageous to separate bleach from perfume.

In recent years there has been a tendency towards the elimination of phosphate from detergents. This elimination does not only have repercussions on the cleaning of the detergent but also on the stability. Phosphate can act as a moisture sink thereby protecting other moisture sensitive ingredients, such as enzymes, contained in the detergent. A present challenge is the stability of moisture sensitive ingredients in compositions free of phosphate.

A problem found with cleaning products in the form of multi-compartment packs, enveloped by water-soluble material, is that the pack can pick up moisture from the surrounding environment and moisture can also migrate between compartments, negatively impacting the stability of the cleaning composition.

In view of the above discussion, an objective of the present invention is to provide a more versatile cleaning product being able to accommodate aqueous compositions.

SUMMARY OF THE INVENTION

According to a first aspect of the invention, there is provided a cleaning product. The product is a water-soluble pack, and comprises a cleaning composition enveloped by water-soluble material. The pack comprises one or more compartments. At least one compartment contains an aqueous cleaning composition or an aqueous auxiliary composition. The aqueous composition is enveloped by a warm water soluble material.

According to a second aspect of the invention, there is provided a cleaning product. The product is a water-soluble pack, and comprises a cleaning composition enveloped by water-soluble material. The pack comprises one or more compartments. At least one compartment contains an aqueous cleaning composition or an aqueous auxiliary composition. The aqueous composition is enveloped by a film comprising polyvinyl acetate with a degree of hydrolysis of from about 90 to about 99%, preferably from about 92 to about 98% and more preferably from about 94 to about 98%. The degree of hydrolysis is expressed as a percentage of vinyl acetate units converted to vinyl alcohol units.

According to a third aspect of the invention, there is provided a cleaning product. The product is a water-soluble pack, and comprises a cleaning composition enveloped by water-soluble material. The pack comprises an outer upper wall and an outer lower wall of enveloping material wherein at least one of the outer walls, preferably both outer walls, is a warm water soluble film. Preferably the warm water soluble film comprises polyvinyl acetate with a degree of hydrolysis of from about 90 to about 99%, more preferably from about 92 to about 98% and especially from about 94 to about 98%.

According to a fourth aspect of the invention, there is provided a cleaning product. The product is a water-soluble pack, and comprises a cleaning composition enveloped by water-soluble material. The pack comprises at least two compartments. At least one compartment contains a liquid composition and another compartment contains a solid composition. The two compositions (liquid and solid) are separated by a warm water soluble film. Preferably the warm water soluble film comprises polyvinyl acetate with a degree of hydrolysis of from about 90 to about 99%, more preferably from about 92 to about 98% and especially from about 94 to about 98%.

The water-soluble material that envelops the cleaning composition of the pack of the invention, can be in the form of: i) a flexible member, such as a film, forming flexible containers, such as sachets, capsules and pouches; or ii) an inflexible member, such as a rigid wall, forming inflexible containers such as those made by moulding, in particular injection moulding. Preferably the water-soluble material is in the form of a water-soluble film or water-soluble moulded wall, more preferably in the form of a film.

Preferably the pack of the invention is a unit dose pack, i.e., a pack containing an amount of cleaning composition enough for a single cleaning operation. The cleaning operation is performed in an aqueous bath.

The aqueous cleaning composition or aqueous auxiliary composition comprises more than 15% by weight of the aqueous composition of free water, preferably from about 15% to about 70%, more preferably from about 20% to about 60%, even more preferably from about 25% to about 55% and especially from about 35% to about 50% by weight of the aqueous composition (i.e., by weight of the aqueous cleaning composition or by weight of the aqueous auxiliary composition). The method to measure the free water of a composition is described hereinbelow. A non-aqueous cleaning composition comprises less than 10%, preferably less than 5% of free water. Usually the solvent in a non-aqueous composition is an anhydrous solvent, particularly an organic solvent.

By "auxiliary composition" is herein meant part of a cleaning composition, that in combination with the rest of the cleaning composition contribute to cleaning. i.e., it is not a complete cleaning formulation.

By "warm water soluble material" is meant a material that takes more than 3 minutes, preferably more than 4 minutes and specially more than or equal to about 5 minutes at 20° C., according the method described hereinbelow.

In contrast, by "cold water soluble material" is meant a material that takes less than 3 minutes, preferably less than 2 minutes and specially less than or equal to about 1 minute at 20° C., according the method described hereinbelow.

As stated hereinabove the warm water soluble material is preferably a warm water soluble film. Preferably the warm water soluble material is a film comprising polyvinyl acetate with a degree of hydrolysis of from about 90 to about 99%, preferably from about 92 to about 98% and more preferably from about 94 to about 98%.

The products of the invention provides great formulation flexibility, the cleaning ingredients can be used as they come, without needing to dry the excess water when they come as aqueous solutions. The products of the invention can also have improved stability under high humidity conditions and permit the handling of the pack with wet hands. A problem found with water-soluble packs is that they can leak prior to use and/or stick together when handled with wet hands, the packs can also become tacky and a bit unpleasant to handle. Several approaches has been taken to tackle the handling of water-soluble packs with wet hands, most of them include coating of the enveloping water-soluble material to a lesser or greater extent. The packs of the present invention overcome the problems associated with the handling with wet hands.

Multi-compartments packs having a compartment containing a solid composition and a compartments containing a liquid composition, sharing a water-soluble wall, can suffer from water migration from one compartment to the next, giving rise to instability issues, in particular associated to moist sensitive ingredients such as enzymes and bleach. The packs of the invention have reduced water migration levels in comparison with traditional packs, improving the stability of the cleaning composition. The packs of the invention not only protect the cleaning ingredients from moist migrating from one compartment to another but also from moist coming from the surrounding environment.

Another advantage of the products of the invention is that they are easier to make than traditional water-soluble packs because the enveloping material seems to be less prone to be affected by the high moisture conditions that can be found in manufacturing plants. Still another advantage of the products of the invention, in particular when it is used in automatic dishwashing is that it can be placed in the main body of the dishwasher, it is no necessary to place it in the dispenser. Usually the pre-wash cycle of an automatic dishwasher takes place at room temperature, so the product of the invention might survive the pre-wash and only release the product during the main wash cycle, when the wash water becomes warm.

The product of the invention can be a single compartment pack, preferably containing an aqueous cleaning composition. In preferred embodiments the pack comprises more than one compartment. This allows the separation of incompatible ingredients and/or ingredients in different physical forms (for example liquid from solid ingredients). The aqueous composition can be in any physical form, preferable in the form of a gel or a liquid, more preferable the aqueous composition is in liquid form.

In preferred multi-compartments (i.e., more than one compartment) embodiments one of the compartments contains a solid composition and another compartment comprises a liquid aqueous composition. In multi-compartment embodiments, different compartments can dissolve at different temperatures to provide differential release. In preferred embodiments, the pack comprises a compartment made of a cold water soluble material, preferably this compartment contains a solid composition, and a compartment made of a warm-water soluble material containing an aqueous composition.

Also preferred herein are multi-compartments embodiments, in which all the compartments are enveloped by a warm water soluble material, preferably having at least one compartment containing a composition in solid form. They provide improved product stability and wet hands handling.

In preferred embodiments the aqueous composition comprises a surfactant, preferably a non-ionic surfactant. This is especially convenient in the case of multi-compartment products comprising a compartment containing a solid composition. It is better in terms of processability and dissolution to have only a small amount (preferably less than 20% and more preferably less than 15% by weight of the composition) or no surfactant in the solid compartment.

In preferred embodiments the composition of the invention is in unit dose form, particularly in the form of a water-soluble pouch. Preferred for use herein are tablets wrapped with a water-soluble film. The weight of the composition of the invention is from about 10 to about 35 grams, preferably from about 12 to about 26 grams and more preferably from 14 to 22 grams. These weights are extremely convenient for automatic dishwashing product dispenser fit. In the cases of unit dose products having a water-soluble material enveloping the detergent composition, the water-soluble material is not considered as part of the composition.

In preferred embodiments the cleaning product comprises a phosphate or non-phosphate detergency builder. Compositions with a non-phosphate detergency builder usually present a better environmental profile. Embodiments comprising a mixture of phosphate and non-phosphate builders have been found to provide good cleaning and at the same time to have an improved environmental profiles with respect to products comprising only phosphate builder.

Phosphate free cleaning compositions seem to have stability problems because phosphate can act as a moisture sink. It has been found that the product of the invention comprising a composition free of phosphate is more stable than traditional products comprising a phosphate free composition.

In other preferred embodiments, the cleaning product comprises an anti-scaling polymer, preferably a sulphonated polymer. These products not only provide a good cleaning but also a good finishing (i.e., they provide good anti-spotting and anti-filming properties). The sulfonated polymer is preferably part of the aqueous composition. Most sulfonated polymers are prepared in aqueous solution and require extra steps to transform it to solid form. Sulfonated polymers in solid form are usually hygroscopic and can give rise to process and in product stability issues. These issues can be avoided by having the sulfonated polymer as part of the aqueous composition.

In preferred embodiments, the product of the invention comprises detergency enzymes, in particular proteases or amylases and mixtures thereof. In multi-compartment embodiments comprising a compartment containing a liquid composition, the enzymes are preferably placed in the liquid composition, for stability reasons. Preferably, if the product comprises bleach the bleach is located in a compartment containing a solid composition for stability reasons.

In automatic dishwashing embodiments comprising a high level of enzymes, the compositions of the invention reduce the particle size of the soil fragments and/or molecular weight as compared to that obtained with traditional detergent compositions. This facilitates the suspension of the soils in the wash liquor. Soil suspension can further be improved by a non-ionic surfactant. The non-ionic surfactant contributes to keep detached soils as individual entities in solution and prevents re-combination that can give rise to grit formation. These surfactants can also help to detach soils from the soiled surfaces. This in combination with soil suspension contributes to a more effective enzymatic cleaning and results in better shine and reduced filming and spotting on the washed items. Preferred non-ionic surfactants have a phase inversion temperature (PIT) in the range of from about 40 to about 70° C. Compositions comprising non-ionic surfactants having a PIT in this temperature range provide very good cleaning. The non-ionic surfactant may also help the enzymes to get to the soiled substrates. The non-ionic surfactant seems to help with the cleaning during the main wash. Some of the surfactant is carried over to the rinse cycle where it helps with sheeting thereby reducing/eliminating filming and spotting. Surfactants, having a PIT in the stated range, present cleaning properties during the main wash and sheeting properties during the rinse. In other preferred automatic dishwashing embodiments the non-ionic surfactant has a Draves wetting time (as measured using the standard method ISO 8022 under the following conditions; 3-g hook, cotton skein, 0.1% by weight aqueous solution at a temperature of 25° C.) of less than about 360 seconds, preferably less than 60 seconds.

The cleaning products of the invention can be used for any cleaning application including hard surface cleaning, for example floor, kitchen and bathroom, hand dishwashing and automatic dishwashing cleaning and laundry cleaning. The products have been found to be especially suitable for automatic dishwashing cleaning, due to the temperature profile of the dishwashing process. Usually a dishwashing process involves a cold pre-wash followed by a main-wash, the main wash involves a cold fill followed by heating of the water to reach the desired temperature, usually between 40 and 60° C. The products of the invention might not dissolve during the pre-wash and only releases the cleaning composition at the optimum time of the main wash, thereby achieving optimum cleaning. Thus, in preferred embodiments of the invention the product is an automatic dishwashing product.

It has been found that warm water soluble materials, particularly in the form of a film, are easier to handle under manufacturing plant conditions than cold water soluble materials. Cold water soluble materials, in particular in film form, tend to roll up or curl at the edges under relative humidity conditions greater than 45%. This curling can lead to wrinkles in the film which produce channels for the cleaning compositions to leak from when the film is used to produce a cleaning product. The film is also prone to crease in the middle part of the film. The humidity of the environment within manufacturing plants must be controlled to avoid this curling and/or wrinkling of the film. This does not seem to occur or is less acute in the case of warm water soluble films.

Thus according to another aspect of the invention, there is provided a process for making a cleaning product comprising the step of placing a warm water soluble film onto a web of forming cavities to form a web of open compartments; filing the compartments with a cleaning composition, preferably an aqueous cleaning composition or auxiliary composition having more than 15% by weight of the composition of free water; and closing and sealing the open compartments with a warm water soluble film.

In another process aspect of the invention, there is provided a process for making the cleaning product of the invention, wherein the product is at least partially formed of injection moulded warm water soluble material; the process comprising the steps of forming an injection moulded open compartment with a warm water soluble material, filling it with as cleaning composition, preferably an aqueous cleaning or auxiliary composition and closing and sealing the open compartment with a warm water soluble film.

The cleaning products of the invention can be used for any type of aqueous cleaning. Preferably the product of the invention is used in automatic dishwashing or laundry cleaning. Thus, according to another aspect of the invention, there is provided a method of cleaning in an automatic dishwashing or laundry machine using the product of the invention. The process comprises the step of using the user's hand to take the product out of a package and placing it in the machine, preferably in the dispenser of the machine. The advantage of the process of the invention is that the product can even be taken out of the package with wet hands without impacting the stability of the remaining pouches in the package and without, the product becoming tacky and sticky.

DETAILED DESCRIPTION OF THE INVENTION

The present invention envisages cleaning products. The products are in the form of a single or multi-compartment pack. In some aspects, at least one compartment of the pack contains an aqueous cleaning or aqueous auxiliary composition enveloped by a warm water soluble material which is slow dissolving under cold water conditions. The product is stable in storage, even under humid conditions (cleaning products are usually stored under the sink or in the utility room, that often are humid environments) and it has improved resistance to the handling with wet hands (very often the user has wet hands when dealing with cleaning tasks). The product of the invention does not become tacky when they are handled with wet hands. Water-soluble packs stored in a package can be prone to leak because of the contact with other packs, if one of the packs containing a liquid composition leaks this can contribute to make the other packs tacky (and unpleasant to handle) and in extreme cases can even dissolve the water-soluble material of other packs. This does not seem to happen with the packs of the invention. Multi-compartment packs comprising a containing with a solid composition and a liquid composition and separated by a warm water soluble film, have improved storage stability. Packs having the outer wall(s) made of warm water soluble film have improved wet handling. Process of manufacture of the packs of the invention presents improved handling of the film.

Packs according to some aspects of the invention have at least one warm-water soluble compartment, i.e. a compartment made of warm water soluble enveloping material. Preferably all the compartments of the pack are warns water soluble, to provide stability benefits as discussed herein before. As indicated before a "warm-water soluble material" within the meaning of this invention is also slow dissolving in cold water.

The present invention also envisages a process for making the product of the invention. The process presents improved handling of the water-soluble enveloping material under high humidity conditions (usually found in manufacturing plants).

Finally the invention also envisages a method of cleaning in a laundry or dishwashing machine. The process allows for the handling of the cleaning product with wet hands.

Solubility Determination Test

Film solubility is evaluated according the following method. Figures illustrating the experimental setting can be found in U.S. Pat. No. 6,787,512 (see FIGS. 1 to 3).

Apparatus and Materials:

600 mL Beaker

Magnetic Stirrer (Labline Model No. 1250)

Magnetic Stirring Rod (5 cm)

Thermometer (1 to 100° C.+/−1° C.)

Template, Stainless Steel (3.8 cm×3.2 cm)

Timer (0-300 seconds, accurate to the nearest second)

Polaroid 35 mm Slide Mount 35 mm Slide Mount Holder with an alligator clamp (as illustrated in FIG. 1 of U.S. Pat. No. 6,787,512)

Distilled Water

Test Specimen:

1. Cut three test specimens from film sample using stainless steel template (i.e. 3.8 cm×3.2 cm specimen). If cut from a film web, specimens should be cut from areas of web equally spaced along the transverse direction of the web.
2. Lock each specimen in a separate 35 mm slide mount.
3. Fill beaker with 500 mL of distilled water. Measure water temperature with thermometer and, if necessary, heat or cool water to maintain temperature at 20° C.,
4. Mark height of column of water. Place magnetic stirrer on base of holder. Place beaker on magnetic stirrer, add magnetic stirring rod to beaker, turn on stirrer, and adjust stir speed until a vortex develops which is approximately one-fifth the height of the water column. Mark depth of vortex.
5. Secure the 35 mm slide mount in the alligator clamp of the 35 mm slide mount holder such that the long end of the slide mount is parallel to the water surface. The depth adjuster of the holder should be set so that when dropped, the end of the clamp will be 0.6 cm below the surface of the water. One of the short sides of the slide mount should be next to the side of the beaker with the other positioned directly over the center of the stirring rod such that the film surface is perpendicular to the flow of the water,
6. In one motion, drop the secured slide and clamp into the water and start the timer. Disintegration occurs when the film breaks apart. When all of the visible film is released from the slide mount, raise the slide out of the water while continuing the monitor the solution for undissolved film fragments. Dissolution occurs when all film fragments are no longer visible and the solution becomes clear, Free Water Determination Test In order to determine the amount of free water present in a composition, a loss-on-drying determination test is carried out using a vacuum oven (Gallenkamp). A sample of 10 g of the composition is placed in a plastic Petri dish having a diameter of 8.5 cm, and then maintained at 60° C. for 3 hours under a partial vacuum of 200 mbar (20 kPa). The oven, is preheated at 60° C. and once 60° C. is achieved the Petri dish containing the sample is placed in the oven. A vacuum pump connected to the oven draws a vacuum of 200 mbar. Once this vacuum is achieved the pump is stopped and the vacuum chamber is closed. After 3 hours the sample is taken out of the oven and it is then re-weighed and the weight loss determined. The weight loss is equated with the amount of free water. The free water of the aqueous composition of the present invention must be greater than 15% by weight of the composition, preferably greater than 20, 25, 30, 35, 40, 45, 50%. Preferably the free water is less than 80%, more preferably less than 70% and even more preferably less than 60% by weight of the composition, Warm Water Soluble Material The warm water soluble material is slow dissolving in cold water. Preferred for use herein are commercially available polyvinyl alcohols (PVA) obtained by hydrolysis of polyvinyl acetates. The solubility of these films can be selectively adjusted by the degree of hydrolysis of the PVA or by using a cross-linking agent. Preferably, the film comprises polyvinyl acetate with a degree of hydrolysis of from about 90 to about 99%, preferably from about 92 to about 98% and more preferably from about 94 to about 98%. The degree of hydrolysis is expressed as a percentage of vinyl acetate units converted to vinyl alcohol units.

Examples of commercially available PVA suitable for use herein are BP26 available from Aicello, L10 and L15 available from Aquafilm. VF-M and VM-S available from Kuraray and E-2060 available from Monosol, especially preferred for use herein is BP26 available from Aicello. The thickness of the material can influence the dissolution kinetics, films having a thickness between about 1 and about 200, more preferably between 10 and 100 μm are preferred for use herein.

Other preferred materials for use herein are starch, starch derivatives, cellulose and cellulose derivatives, more especially methyl cellulose and mixture thereof. Especially preferred for use herein are polymers comprising hydroxypropylmethylcellulose.

Cold Water Soluble Material

The product of the invention can also comprise a cold water soluble film.

Preferably, the cold water soluble film comprises polyvinyl acetate having a degree of hydrolysis, expressed as a percentage of vinyl acetate units converted to vinyl alcohol units, in the range of from about 55% to about 85%, from about 60% to about 80%, from about 65% to about 75%, or any other suitable combinations of upper and lower ranges.

Non-limiting, examples of cold water soluble films, include PVA films known under the trade reference Monosol M8630, as sold by Chris-Craft Industrial Products of Gary, Ind., US, and PVA films of corresponding solubility characteristics. Other films suitable for use herein include films known under the trade reference PT film or the K-series of films supplied by Aicello, or VF-HP film supplied by Kuraray.

The films for the pack of the present invention can also comprise an additional monomer selected from the group of:

acrylic acid-containing polymers, polyacrylamides, oxazoline polymers, polystyrenesulfonates, polyurethanes, polyesters, polyethers and mixtures thereof.

The films herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

Cleaning Actives

Any traditional cleaning ingredients can be used as part of the product of the invention. The levels given are weight percent and refer to the total composition (excluding the enveloping water-soluble material). The cleaning product can contain a phosphate builder or be free of phosphate builder and comprise one or more detergent active components which may be selected from bleach, bleach activator, bleach catalyst, surfactants, alkalinity sources, enzymes, anti-scaling polymers, anti-corrosion agents (e.g. sodium silicate) and care agents. Highly preferred cleaning components include a builder compound, an alkalinity source, a surfactant, an anti-scaling polymer (preferably a sulfonated polymer), an enzyme and an additional bleaching agent.

Surfactant

Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and suifosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$-$C_{16}$ N-alkyl or alkenyl ammonium surfactants wherein the remaining N positions are substituted by methyl, hydroxyethyl or hydroxypropyl groups Other suitable surfactants for use herein include non-ionic surfactants. These surfactants are particularly useful in automatic dishwashing compositions. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the product of the invention comprises is a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase, inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit $[CH_2CH(OH)R_2]$. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation. Preferably non-ionic surfactants and/or system to use as anti-redeposition agents herein have a Draws wetting time of less than 360 seconds, preferably less than 200 seconds, more preferably less than 100 seconds and especially less than 60 seconds as measured by the Draves wetting method (standard method ISO 8022 using the following conditions; 3-g hook, 5-g cotton skein, 0.1% by weight aqueous solution at a temperature of 25° C.).

Amine oxides surfactants are also useful in the present invention as anti-redeposition surfactants include linear and branched compounds having the formula:

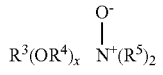

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{18}$ alkoxy ethyl dihydroxyethyl amine oxides. Examples of such materials include dimethyloctylamine oxide, diethyl decyl amine oxide, hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$-$C_{18}$ alkyl dimethylamine oxide, and $C_{10-18}$ acylamido alkyl dimethylamine oxide.

Surfactants may be present in amounts from 0 to 10% by weight, preferably from 0.1% to 10%, and most preferably from 0.25% to 6% by weight of the total composition. Preferably the product of the invention comprises from 0.1 to 10% of non-ionic surfactant wherein at least 50%, more preferably at least 60% of the total amount of non-ionic surfactant is in the aqueous composition, Builder Builders for use herein include phosphate builders and phosphate free builders. If present, builders are used in a level of from 5 to 60%, preferably from 10 to 50%, more preferably from 10 to 50% by weight of the composition. In some embodiments the product comprises a mixture of phosphate and non-phosphate builders.

Phosphate Builders

Preferred phosphate builders include mono-phosphates, di-phosphates, tri-polyphosphates or oligomeric-polyphosphates are used. The alkali metal salts of these compounds are preferred, in particular the sodium salts. An especially preferred builder is sodium tripolyphosphate (31'PP), Non-Phosphate Builders Preferred non-phosphate builders include amino acid based compounds, in particular MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Suitable builders for use herein, in addition or instead of MGDA and/or GUM, include builders which forms water-soluble hardness ion complexes (sequestering builder) such as citrates and builders which forms hardness precipitates (precipitating builder) such as carbonates e.g. sodium carbonate.

Other suitable non-phosphate builders include amino acid based compound or a succinate based compound. The term "succinate based compound" and "succinic acid based compound" are used interchangeably herein. Other suitable builders are described in U.S. Pat. No. 6,426,229. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALTA) serine-N,N-diacetic acid (SEDA), isoserine-N,N-diacetic acid (ISDA), phenylalanine-N,N-diacetic acid (PHDA) anthranilic acid-N,N diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Preferably the non-phosphate builder is present in the composition in an amount of at least 1%, more preferably at least 5%, even more preferably at least 10%, and most especially at least 20% by weight of the total composition. Preferably these builders are present in an amount of up to 50%, more preferably up to 45%, even more preferably up to 40%, and especially up to 35% by weight of the total composition. In preferred embodiments the composition contains 20% by weight of the total composition or less of phosphate builders, more preferably 10% by weight of the total composition or less, most preferably they are substantially free of phosphate builders.

Other non-phosphate builders include homopolymers and copolymers of polycarboxylic acids and their partially or completely neutralized salts, monomeric polycarboxylic acids and hydroxycarboxylic acids and their salts. Preferred salts of the ahovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Anti-Scaling Polymer

The polymer, if present, is used in any suitable amount from about 0.1% to about 50%, preferably from 0.5% to about 20%, more preferably from 1% to 10% by weight of the composition. Sulfonated/carboxylated polymers are particularly suitable for the products of the invention, in particular in the case of automatic dishwashing compositions.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

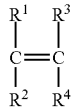

(I)

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

(II)

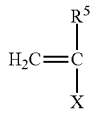

wherein $R^6$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

(III)

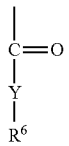

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

(IV)

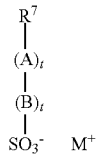

wherein $R^7$ is a group comprising at least one $sp^2$ bond, A is O, N, P, S or an amido or ester linkage, B is a mono- or polycyclic aromatic group or an aliphatic group, each t is independently 0 or 1, and M is a cation. In one aspect, $R^7$ is a $C_2$ to $C_6$ alkene. In another aspect, $R^7$ is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth)acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzesulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-amilamido-2-propanesulfonic acid (AMPS). Preferred commercial available polymers include: Alcosperse 240, Aquatreat AR 540 and Aquatreat MPS supplied by Alco Chemical; Acumer 3100, Acumer 2000, Acusol 5870 and Acusol 5880 supplied by Rohm & Haas; Goodrich K-798, K-775 and K-797 supplied by BF Goodrich; and ACP 1042 supplied by ISP technologies Inc. Particularly preferred polymers are Acusol 5870 and Acusol 5880 supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Silicates

Preferred silicates are sodium silicates such as sodium disilicate, sodium metasilicate and crystalline phyllosilicates. Silicates if present are at a level of from about 1 to about 20%, preferably from about 5 to about 15% by weight of composition.

Bleach

Inorganic and organic bleaches are suitable cleaning actives for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability. A suitable coating material providing in product stability comprises mixed salt of a water-soluble alkali metal sulphate and carbonate. Such coatings together with coating processes have previously been described in GB-1,466,799. The weight ratio of the mixed salt coating material to percarbonate lies in the range from 1:200 to 1:4, more preferably from 1:99 to 1:9, and most preferably from 1:49 to 0.1:1.9. Preferably, the mixed salt is of sodium sulphate and sodium carbonate which has the general formula Na2S04.n.Na2CO3 wherein n is from 0.1 to 3, preferably n is from 0.3 to 1.0 and most preferably a is from 0.2 to 0.5.

Another suitable coating material providing in product stability, comprises sodium silicate of Si02:Na20 ratio from 1.8:1 to 3.0:1, preferably 1.8:1 to 2.4:1, and/or sodium metasilicate, preferably applied at a level of from 2% to 10%, (normally from 3% to 5%) Of Si02 by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

The diacyl peroxide, especially dibenzoyl peroxide, should preferably be present in the form of particles having a weight average diameter of from about 0.1 to about 100 microns, preferably from about 0.5 to about 30 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Diacyl peroxides within the above particle size range have also been found to provide better stain removal especially from plastic dishware, while minimizing undesirable deposition and filming during use in automatic dishwashing machines, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Further typical organic bleaches include the peroxy acids, particular examples being the alkylperoxy acids and the arylperoxy acids. Preferred representatives are (a) peroxybenzoic acid and its ring-substituted derivatives, such as alkylperoxyberizoic acids, but also peroxy-α-naphthoic acid and magnesium monoperphthalate, (b) the aliphatic or substituted aliphatic peroxy acids, such as peroxylauric acid, peroxystearic acid, ϵ-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Preferably the products of the invention contain percarbonate. Also preferred are products comprising percarbonate and PAP.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2, to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetracetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 1.0%, preferably from about 0.5 to about 2% by weight of the total composition.

Bleach Catalyst

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16. Bleach catalyst if included in the compositions of the invention are in a level of from about 0.1 to about 10%, preferably from about 0.5 to about 2% by weight of the total composition.

Enzyme

Suitable proteases include metalloproteases and serine proteases, including neutral or alkaline microbial serine proteases, such as subtilisins (EC 14.21.62). Suitable proteases include those of animal, vegetable or microbial origin. Microbial origin is preferred. Chemically or genetically modified mutants are included. The protease may be a serine protease, preferably an alkaline microbial protease or a chymotrypsin or trypsin-like protease. Examples of neutral or alkaline proteases include:

(a) subtilisins (EC 3.4.21.62), especially those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, DEA6022216A1 and DEA 6022224A1.

(b) trypsin-like or chymotrypsin-like proteases, such as trypsin (e.g., of porcine or bovine origin), the *Fusarium* protease described in WO 89/06270 and the chymotrypsin proteases derived from Cellumonas described in WO 05/052161 and WO 05/052146.

(c) metalloproteases, especially those derived from *Bacillus amyloliquelaciens* described in WO 07/044,993A2.

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novo Nordisk A/S (Denmark), those sold under the tradename Maxatase®, Maxacal®, Maxapem®, Properase®, Purafect®, Purafect Prime®, Purafect Ox®, FN3®, FN4®, Purafect OXP® and Excellase® by Genencor International, and those sold under the tradename Opticlean® and Optimase® by Solvay Preferably the cleaning product of the invention comprises at least 0.001 mg of active protease. In further preferred embodiments, the composition comprises a high level of protease, in particular at least 0.1 mg of active protease per gam of composition. Preferred levels of protease in the compositions of the invention include from about 1.5 to about 10, more preferably from about 1.8 to about 5 and especially from about 2 to about 4 mg of active protease per gram of composition.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S.

Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:
26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484 that also preferably contain the deletions of D183* and G184*.

(c) variants exhibiting at least 90% identity with SEQ II) No. 4 in WO06/002643, the wild-type enzyme from *Bacillus* SP722, especially variants with deletions in the 183 and 184 positions and variants described in WO 00/60060, which is incorporated herein by reference.

Suitable commercially available alpha-amylases are DURAMYL®, LIQUEZYME® TERMAMYL®, TERMAMYL ULTRA®, NATALASE®, SUPRAMYL®, STAINZYME®, STAINZYME PLUS®, FUNGAMYL® and BAN® (Novozymes VS), BIOAMYLASE—D(G), BIOAMYLASE® L (Biocon India Ltd.), KEMZYM® AT 9000 (Biozym Ges. m.b.H, Austria), RAPIDASE®, PUEASTAR®, OPTISIZE HT PLUS® and PURASTAR OXAM® (Genencor international Inc.) and KAM® (KAO, Japan). In one aspect, preferred amylases are NATALASE®, STAINZYME® and STAINZYME PLUS® and mixtures thereof.

Preferably, the composition comprises at least 0.001 mg of active amylase. In preferred embodiments high level of amylase is used, at least 0.05 mg of active amylase per gram of composition, preferably from about 0.1 to about 10, more preferably from about 0.25 to about 6, specially preferred from about 0.3 to about 4 mg of active amylase per gram of composition. It has been found that compositions comprising a high level of amylase help to prevent grit formation during the automatic dishwashing process, providing good cleaning and finishing results. Better results in terms of grit removal can be achieved when the composition comprises a lipase, thus in a preferred embodiment the composition of the invention comprise a lipase, preferably a lipase derived from the *Humicola Lanuginosa* wild-type that contains the mutations T231R and N233R. Compositions comprising Lipex® (Novozymes A/S, Bagsvaerd, Denmark) have been found particularly effective in terms of grit prevention.

Enzyme Form

The enzyme can be provided either in the form of a low-dusting solid (typically a granule or prill) or as a stabilized liquid or as a protected liquid or encapsulated enzyme. Numerous techniques are described in the art to produce low-dusting solid forms of enzymes, including prilling, extrusion, spheronization, drum granulation and fluid bed spray coating and exemplified is U.S. Pat. No. 4,106,991; U.S. Pat. No. 4,242,219; U.S. Pat. No. 4,689,297, U.S. Pat. No. 5,324,649 and U.S. Pat. No. 7,018,821 which are herein incorporated by reference. Liquid enzyme preparations may, for instance, be stabilized by adding a polyol such as propylene glycol, a sugar or sugar alcohol, lactic acid or boric acid according to established methods. Protected liquid enzymes or encapsulated enzymes may be prepared according to the methods disclosed in U.S. Pat. No. 4,906,396, U.S. Pat. No. 6,221,829, U.S. Pat. No. 6,359,031 and U.S. Pat. No. 6,242,405 which are herein incorporated by reference.

Enzyme stabilizer components—Suitable enzyme stabilizers include oligosaccharides, polysaccharides and inorganic divalent metal salts, such as alkaline earth metal salts, especially calcium salts. Chlorides and sulphates are preferred with calcium chloride an especially preferred calcium salt. Examples of suitable oligosaccharides and polysaccharides, such as dextrins, can be found in WO07/145,964A2 which is incorporated herein by reference. In case of aqueous compositions comprising protease, a reversible protease inhibitor, such as a boron compound, including borate and 4-formyl phenyl boronic acid or a tripeptide aldehyde, can be added to further improve stability.

Metal Care Agents

Metal care agents may prevent or reduce the tarnishing, corrosion or oxidation of metals, including aluminium, stainless steel and non-ferrous metals, such as silver and copper. Suitable examples include one or more of the following:

(a) benzatriazoles, including benzotriazole or bis-benzotriazole and substituted derivatives thereof. Benzotriazole derivatives are those compounds in which the available substitution sites on the aromatic ring are partially or completely substituted. Suitable substituents include linear or branch-chain $C_1$-$C_{20}$-alkyl groups and hydroxyl, thio, phenyl or halogen such as fluorine, chlorine, bromine and iodine.

(b) metal salts and complexes chosen from the group consisting of zinc, manganese, titanium, zirconium, hafnium, vanadium, cobalt, gallium and cerium salts and/or complexes, the metals being in one of the oxidation states II, III, IV, V or VI. In one aspect, suitable metal salts and/or metal complexes may be chosen from the group consisting of Mn(II) sulphate, Mn(II) citrate, Mn(II) stearate, Mn(II) acetylacetonate, $K_2TiF_6$, $K_2ZrF_6$, $CoSO_4$, $Co(NO_3)_2$ and $Ce(NO_3)_3$, zinc salts, for example zinc sulphate, hydrozincite or zinc acetate;

(c) silicates, including sodium or potassium silicate, sodium disilicate, sodium metasilicate, crystalline phyllosilicate and mixtures thereof.

Further suitable organic and inorganic redox-active substances that act as silver/copper corrosion inhibitors are disclosed in WO 94/26860 and WO 94/26859.

Preferably the composition of the invention comprises from 0.1 to 5%, more preferably from 0.2 to 4% and specially from 0.3 to 3% by weight of the total composition of a metal care agent, preferably the metal care agent is a zinc salt, Water-Soluble Pack Preferably the product of the invention is a unit-dose product. Products in unit dose form include tablets, capsules, sachets, pouches, etc. Preferred for use herein are unit dose form wrapped with a water-soluble film (including tablets, capsules, sachets, pouches) and injection moulded containers.

A multi-compartments pack is formed by a plurality of water-soluble enveloping materials which form a plurality of compartments, the compartment containing the aqueous composition is made of warm water soluble material. In some embodiments other compartments, preferably a compartment comprising a solid composition, are made of cold water soluble material. It allows for the separation and controlled release of different ingredients. In other embodiments all the compartments are made of warm water soluble material.

In preferred embodiments the composition of the invention is in the form of a water-soluble pouch or an injection moulded container. The weight of the composition of the invention is from about 10 to about 35 grams, preferably from about 12 to about 26 grams and more preferably from 1.4 to 22 grams. These weights are extremely convenient for automatic dishwashing product dispenser fit. In the cases of unit dose products having a water-soluble material enveloping the detergent composition, the water-soluble material is not considered as part of the composition.

Preferred packs comprise at least two side-by-side compartments superposed (i.e., placed above) onto another compartment, especially preferred are pouches. This disposition contributes to the compactness, robustness and strength of the pack, additionally, it minimise the amount of water-soluble material required. It only requires three pieces of material to form three compartments. The robustness of the pack allows also for the use of very thin films without compromising the physical integrity of the pack. The pack is also very easy to use because the compartments do not need to be folded to be used in machine dispensers of fix geometry. At least two of the compartments of the pack contain two different compositions. By "different compositions" herein is meant compositions that differ in at least one ingredient.

Preferably, at least one of the compartments contains a solid composition and another compartment an aqueous liquid composition, the compositions are preferably in a solid to liquid weight ratio of from about 20:1 to about 1:20, more preferably from about 18:1 to about 2:1 and even more preferably from about 15:1 to about 5:1. The pack of the invention is very versatile because it can accommodate compositions having a broad spectrum of values of solid:liquid ratio. Particularly preferred have been found to be pouches having a high solid:liquid ratio because many of the detergent ingredients are most suitable for use in solid form, preferably in powder form. The ratio solid:liquid defined herein refers to the relationship between the weight of all the solid compositions and the weight of all the liquid compositions in the pack.

In other embodiments the solid:liquid weight ratio is from about 2:1 to about 18:1, more preferably from about 5:1 to about 15:1. These weight ratios are suitable in cases in which most of the ingredients of the detergent are in liquid form.

In preferred embodiments the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons, especially in an automatic dishwasher, the unit dose form products herein have a square or rectangular base and a height of from about 1 to about 5 cm, more preferably from about 1 to about 4 cm. Preferably the weight of the solid composition is from about 10 to about 22 grams, more preferably from about 15 to about 20 grams and the weight of the liquid compositions is from about 0.5 to about 4 grams, more preferably from about 0.8 to about 3 grams.

The multi-compartment pack of the invention is very versatile in terms of dissolution profile. In preferred embodiments, at least two of the films which form different compartments have different solubility, under the same conditions, releasing the content of the compositions which they partially or totally envelope at different times.

The enzymes can lose stability in product, due to its interaction with bleach and builders (they can destabilize the enzyme by binding to the calcium of the enzymes). In addition, the performance of enzymes in a cleaning solution can be impaired by the alkalinity of the solution, bleach, builders, etc. In preferred embodiments, one of the compositions of the multi-compartment pack, preferably a solid composition, comprises bleach and another composition, preferably a composition in liquid form, comprises enzymes. It is also preferred that one of the films enclosing the enzyme-comprising composition dissolves prior to the films enclosing the bleach-containing composition during the main-wash cycle of an automatic dishwashing machine, thereby releasing the enzyme-containing composition into the wash liquor prior to the delivery of the bleach-containing composition. This gives the enzymes the possibility to operate under optimum condition, avoiding interactions with other detergent actives. The pouch provides excellent cleaning. It is preferred that the bleach-containing composition comprises also a builder.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. No. 4,765,916 and U.S. Pat. No. 4,972,017. Waxy coating (see WO 95/29982) of films can help with rinse release, pH controlled release means are described in WO 04/111178, in particular amino-acetylated polysaccharide having selective degree of acetylation.

Other means of obtaining delayed release by multi-compartment pouches with different compartments, where the compare are made of films having different solubility are taught in WO 02/08380.

Abbreviations Used in the Example

In the example, the abbreviated component identifications have the following meanings:

Carbonate: Anhydrous sodium carbonate

STPP: Sodium tripolyphosphate anhydrous

Silicate: Amorphous Sodium Silicate ($SiO_2$:$Na_2O$=from 2:1 to 4:1)

Alcosperse 240-D: Sulfonated polymer available from Alco Chemical 95% solids

Percarbonate: Sodium percarbonate of the nominal formula $$2Na_2CO_3.3H_2O_2$$

TAED: Tetraacetylethylenediamine

SLF18: Non-ionic surfactant available from BASF

DPG: dipropylene glycol

In the following example all levels are quoted in percent by weight of the composition (either solid or liquid composition).

EXAMPLES

The compositions tabulated below are introduced into a multi-compartment pouch having a first compartment comprising the solid composition (in powder form) and a liquid compartment superposed onto the powder compartment comprising an aqueous liquid composition. The bottom film is Monosol M8630, supplied by Monosol. The middle and top films, i.e., the films used for the liquid compartment is a warm water soluble film, supplied by Monosol. The weight of the solid composition is 17 grams and the weight of liquid compositions is 2 grams.

| Ingredient | Level (% wt) |
|---|---|
| Solid composition | |
| STPP | 40 |
| Carbonate | 24 |
| Silicate | 7 |
| TAED | 0.5 |
| Zinc carbonate | 0.5 |
| SLF18 | 1.5 |
| Percarbonate | 15 |
| Alcosperse 240D | 10 |
| Enzymes | 1 |
| Processing aids | To balance |
| Liquid composition | |
| DPG | 5 |
| Non-ionic surfactant | 65 |
| Amino oxide surfactant | 5 |
| Glycerine | 2 |
| Water | 23 |
| Processing aids | To balance |

The exemplified pouch has good storage stability and keeps its integrity when handled with wet hands.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water soluble pack comprising a total composition contained by a water-soluble enveloping material, wherein the total composition comprises an aqueous composition and a solid composition, and wherein the total composition is free of phosphate, wherein the aqueous composition is contained in a first compartment of the pack and the solid composition is contained in a second compartment of the pack;

wherein the aqueous composition comprises water and a nonionic surfactant;

wherein the nonionic surfactant comprises from about 0.1% to about 10% by weight of the total composition, wherein the solid composition comprises: an amino acid based builder; a polymer; and zinc sulfate;

wherein the amino acid based builder is selected from the group consisting of a methyl-glycine diacetic acid, glutamic-N, N-diacetic, and mixture thereof, and wherein the amino acid based builder comprises from about 5% to about 60% by weight of the total composition;

wherein the polymer is selected from the group consisting of a sulfonated polymer, carboxylated polymer, and a mixture thereof, and wherein the polymer comprises from about 0.5% to about 20% by weight of the total composition;

wherein the zinc sulfate comprises from about 0.1% to about 5% by weight of the total composition.

2. A water soluble pack according to claim 1, wherein the total composition further comprises a bleach.

3. A water soluble pack according to claim 2, wherein the bleach is percarbonate.

4. A water soluble pack according to claim 1, wherein the total composition further comprises a bleach activator.

5. A water soluble pack according to claim 4, wherein the bleach activator is a polyacylated alkylenediamine.

6. A water soluble pack according to claim 5, wherein the bleach activator is present from about 0.5% to about 2% by weight of the total composition.

7. A water soluble pack according to claim 1, wherein the total composition further comprises an enzyme.

8. A water soluble pack according to claim 7, wherein the enzyme is selected from the group consisting of a protease, an alpha amylase, and mixtures thereof.

9. A water soluble pack according to claim 8, wherein the enzyme is present from about 1.8 mg to about 5 mg by weight of the total composition.

10. A water soluble pack according to claim 1, wherein at least 50% of the total amount of nonionic surfactant is in the aqueous composition.

11. A water soluble pack according to claim 1, wherein the aqueous composition to solid composition weight ratio is from about 15:1 to about 5:1.

12. A water soluble pack according to claim 1, wherein the solid composition comprises from about 10 grams to about 22 grams, and wherein the aqueous composition comprises from about 0.8 grams to about 3 grams.

13. A water soluble pack according to claim 7, wherein the enzyme is not contained in the solid composition.

14. A water soluble pack according to claim 13, wherein the solid composition comprises a bleach.

15. A water soluble pack according to claim 1, where the nonionic surfactant is an epoxy-capped poly(oxyalkylated) alcohol of the formula:

$$R_1O[CH_2CH(CH_3)O]_x[CH_2CH_2O]_y[CH_2CH(OH)R_2]$$

wherein $R_1$ is a linear or branched aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5; and y is an integer having a value of at least 15.

16. A water soluble pack according to claim 1, wherein the nonionic surfactant is present from about 0.25% to about 6% by weight of the total composition.

17. A water soluble pack according to claim 1, wherein the amino acid based builder is present from about 5% to about 35% by weight of the total composition.

18. A water soluble pack according to claim 1, wherein the polymer is present from about 1% to about 10% by weight of the total composition.

19. A method of treating dishware comprising the step of dosing the water soluble pack of claim 1 into an automatic dishwasher machine.

* * * * *